US005361497A

United States Patent [19]

Crawford

[11] Patent Number: 5,361,497

[45] Date of Patent: Nov. 8, 1994

[54] FOLDING KNIFE HOLDER AND METHOD FOR ONE-HANDED OPENING OF A FOLDING KNIFE

[76] Inventor: Kenneth R. Crawford, 9009 N. Plaza, No. 109, Austin, Tex. 78753

[21] Appl. No.: 61,587

[22] Filed: May 12, 1993

[51] Int. Cl.[5] ..... B26B 3/06; B26B 29/02

[52] U.S. Cl. ..... 30/155; 70/151

[58] Field of Search ..... 30/151, 155, 258, 321, 30/88; D7/637

[56] References Cited

U.S. PATENT DOCUMENTS

| | | | |
|---|---|---|---|
| D. 329,783 | 9/1992 | Ancona | D7/637 |
| 3,771,225 | 11/1973 | Unger | 30/155 |
| 4,466,561 | 8/1984 | Slaughter | 30/155 |
| 4,494,310 | 1/1985 | Slaughter | 30/155 |

*Primary Examiner*—Richard K. Seidel
*Assistant Examiner*—Paul M. Heyrana, Sr.
*Attorney, Agent, or Firm*—Graves, Dougherty, Hearon & Moody

[57] ABSTRACT

A folding knife holder and method, whereby a folding knife can be safely carried in an elongate knife holder, comprising a housing member that has an elongate recess defined by a base surface, side surfaces and end surfaces, and sized and shaped to receive the knife in an orientation that is substantially parallel to the base surface, with the spine of the knife laying against the base. The margin of the walls of the housing member define an elongate orifice opening into the recess. The orifice is partially occluded at one end by a strike member. The strike member has a gap, wider than the knife blade. When the back of the knife blade is grasped and pulled in an outward direction, the knife blade will pass through the gap in the strike member and the strike member will blockingly engage the butt of the knife handle, thereby allowing the knife blade to be pivotably rotated into an open position.

18 Claims, 3 Drawing Sheets

FOLDING KNIFE HOLDER AND METHOD FOR ONE-HANDED OPENING OF A FOLDING KNIFE

BACKGROUND OF THE INVENTION

1. Field of The Invention

Applicant's invention relates to means and a method for safely carrying a large folding knife. More specifically, the present invention relates to a novel folding knife holder and method that allow the user to safely carry a large folding knife in an accessible manner, and that allow the user to open the folding knife with one hand, as the folding knife is removed from the knife holder.

2. Background Information

Large folding knives are useful for many projects and in many occupations. Typically, a person who uses a large folding knife on a regular basis wishes to carry the knife in a convenient, accessible manner. Large folding knives, however, are usually too large to be comfortably carried in a pocket. Thus, sheaths or other carrying devices were developed to carry folding knives on a belt, either by a clip, or by a belt loop. The conventional folding knife holder is a vertical pouch-type sheath with a flap that covers the opening of the sheath. The sheath is generally made of molded leather and uses a snap fastener for the flap, or is made from lightweight, waterproof nylon, and uses a velcro closure for the flap.

Although this design of sheath allows a large folding knife to be safely carried, it has many shortcomings. First, the sheath is visually obtrusive, because it is designed to hang from a belt. Second, the sheath is only attached to the belt at the sheath's upper end, and is not securely attached to the body of the user. Thus, when a folding knife is carried in the sheath, any rapid movement by the user, such as walking or running, or any attempt by the user to rapidly remove the knife from the sheath will cause the sheath to move back and forth in an annoying manner.

Finally, and most importantly, removing a folding knife from a conventional knife sheath and opening the knife is a relatively time-consuming, multi-step process that requires a two-handed operation. The flap of the knife sheath must first be opened and held in an upright position, while the knife is simultaneously grasped and pulled from the sheath. After the knife is removed, the knife must be opened to a locked position. Because a folding knife is usually biased to a closed position until the knife blade is at least partially rotated from the handle, a user of a folding knife generally must use both hands to open the knife—one hand positioned on the knife handle and the other hand positioned to pivot the knife blade from the handle.

Several attempts have been made to develop a folding knife holder that allows a folding knife to be removed from the holder and simultaneously opened with only one hand. For example, U.S. Pat. No. 4,525,928, issued to Foster on Jul. 2, 1985, discloses a scabbard for a folding knife. The closed folding knife is inserted blade-side first into the scabbard in such a manner that pins or ridges in the scabbard nest within the thumb slit on the knife blade. As the folding knife is removed from the scabbard, the pins in the sheath engage the thumb slit of the knife blade, causing the knife blade to be pivoted into an open position. Although the invention disclosed in Foster is an improvement over a conventional sheath, because it allows one-handed operation, the means used in Foster to achieve this result are problematic. For example, to use the scabbard in Foster properly, the folding knife must have a sufficiently deep thumb slit in the blade. In addition, care must be taken to place the folding knife into the scabbard in a correct position to ensure that the pins engage with the thumb slit. Finally, to use the invention disclosed in Foster, the pins in the scabbard must be placed in such a manner as to always engage the thumb slit in the knife blade, thereby requiring that the scabbard be custom-made for each knife.

U.S. Pat. No. 4,561,577 issued to Moore on Dec. 31, 1985, discloses a knife holster for carrying a folding knife, in which the folding knife with the blade in an open position is inserted into the holster in an downward sliding motion. This action causes the upper margin of the knife blade to engage a catch portion in the holster. The knife is then pivoted to a substantially closed position in the holster. When the knife is removed from the holster, the catch portion of the holster causes the blade to pivot to an open position. The invention disclosed in Moore does allow one-handed operation, but requires that the knife be dangerously inserted into the holster with the blade in a partially open position. In addition, extra care must be taken to ensure that the knife is correctly positioned in the holster to engage the catch portion.

U.S. Pat. No. 4,494,309 issued to Gray on Jan. 22, 1985, also discloses a folding-knife holder that allows one-handed operation. The holder disclosed in Gray has flexible side walls that are compressed as the folding knife is inserted into the holder and then expand against the knife, thereby holding the knife into position. The knife is removed by grasping the outer edge of the blade and pivoting the blade to an open position, with the flexible side walls of the knife holder engaging the knife handle until the blade is in an open position. The holder disclosed in Gray does allow one-handed operation, but relies solely on flexible side walls for retention of the knife in the holder. These side walls will lose their elasticity over time, thereby failing to hold the knife in position.

In addition to the patents described above, the following patents also describe various holders for folding knives:

| Patentee | Patent Number |
|---|---|
| Morgan | 4,426,779 |
| Maihos | 4,600,133 |
| O'Dell | 4,848,000 |
| Reynolds | 4,909,424 |

SUMMARY OF THE INVENTION

It is an object of the present invention to provide a novel holder for a folding knife.

It is another object of the present invention to provide a holder that allows a large folding knife to be safely carried in the holder and be easily inserted into and removed from the holder.

It is yet another object of the present invention to provide a holder that allows a large folding knife to be securely retained therein, and further allows a large folding knife to be easily removed from the holder and opened, by using only one hand.

It is a further object of the present invention to provide a holder that allows a large folding knife to be rapidly inserted into the sheath, to be securely retained therein, and to be removed therefrom and simultaneously opened by grasping the back edge of the blade and pivoting the knife blade to an open position.

It is yet another object of the present invention to provide a knife holder that unobtrusively attaches to and conforms to the line of a belt.

It is yet another object of the present invention to provide a novel method for one-handed opening of a folding knife, using a holder that allows the knife to be rapidly inserted into the sheath, to be securely retained therein, and to be removed therefrom and simultaneously opened by grasping the back edge of the blade and pivoting the knife from the holder.

In satisfaction of these and related objectives, Applicant's present invention provides for folding knife holder for retaining a large folding knife, said holder having an interior housing member recess sized and shaped for receiving a folding knife therein, and having a slotted strike member at one end that retains the butt of the knife handle in the housing member recess, but which allows the tip of the knife blade to pass through the slot in the strike member as the back side of the knife blade is grasped and pivoted from the knife handle into an open position.

BRIEF DESCRIPTION OF THE DRAWINGS

Applicant's invention may be further understood from a description of the accompanying drawings wherein, unless otherwise specified, like reference numbers are intended to depict like components in the various views.

DETAILED DESCRIPTION OF THE PREFERRED EMBODIMENT

Figure 1:
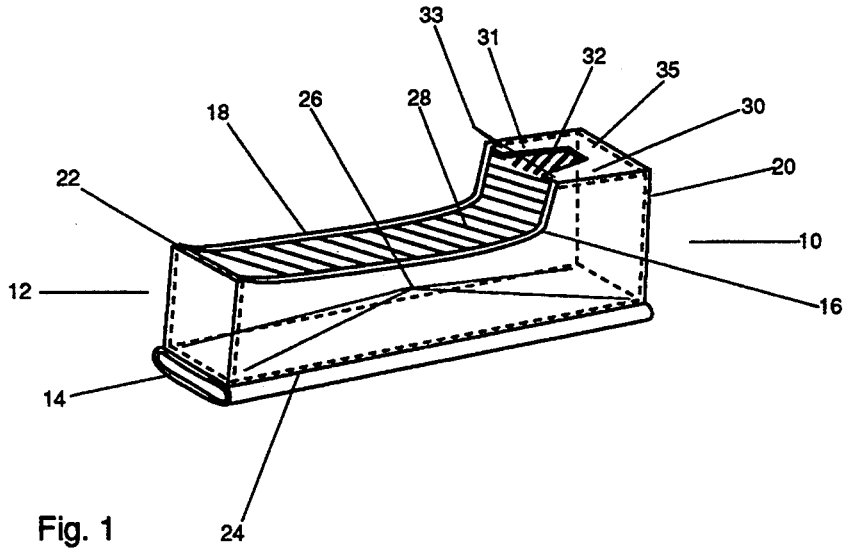
FIG. 1 is a perspective view of the preferred embodiment.

Referring to FIG. 1, the perspective view of the preferred embodiment, the knife holder (10) comprises an elongate housing member (12) and a belt loop (14). The housing member has an interior housing member recess (26), which is defined by the inner surfaces of a first side wall (16), a second side wall (18), a primary end wall (20), a secondary end wall (22) and an elongate base (24) of the housing member (12). The belt loop (14) is attached to the exterior surface of the housing member base (24) and runs the length of the housing member (12). This arrangement allows the knife holder to be carried unobtrusively on a belt in a horizontal position, along the line of the belt. Other conventional means for attaching the housing member to a belt, or to a different clothing accessory, could be used in place of a belt loop, such as clips or snaps.

The housing member recess (26) is sized and shaped for receiving and removably retaining a conventional folding knife (not shown). The margins of the walls of the housing member define an elongate orifice (28), which opens into the housing member recess, and which is partially occluded near the primary end wall (20) by a strike member (30).

At the juncture of the strike member to the margins of the primary end wall, the first side wall and second side wall, these walls are raised, thereby increasing the depth of the housing member recess for better accommodating the butt of the knife handle. The strike member (30) has a strike member gap (32) that is of sufficient width to allow the knife blade of a folding knife to pass through the strike member gap (32), without allowing the butt of the knife handle to pass through the strike member gap, when the back side of the knife blade is grasped and pulled out in an outward direction, away from the housing member (12). When this outward pulling force is exerted on the knife blade, the blocking engagement between the strike member (30) and the butt of the knife handle allows the knife blade to pivot into an open position. The strike member gap effectively divides the strike member into a first strike member prong (31), a second strike member prong (33) and a strike member base (35).

The housing member can be made from a variety of materials, such as plastic, metal, wood derivatives or molded leather and should be sufficiently rigid to retain the folding knife in the housing member recess (26) when the knife is inserted for storage. The strike member (30) preferably is made from a rigid, durable material, such as steel or hardened plastic, that will withstand repeated bumps from the butt of the knife handle.

Figure 1A:
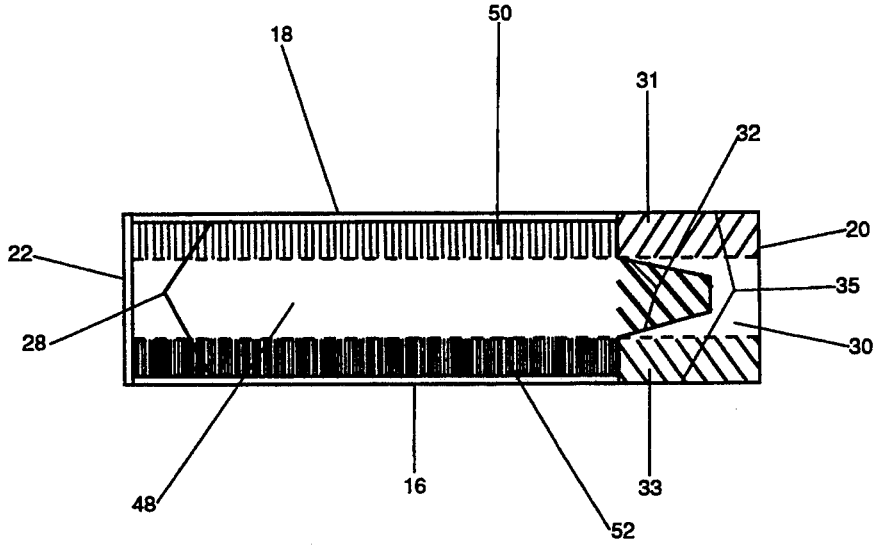
FIG. 1*a* is a top view of the preferred embodiment.

FIG. 1*a* is a top view of the preferred embodiment and shows the elongate orifice (28) and the strike member (30) partially occluding the orifice. For convenience of reference, the elongate orifice (28) can be divided into three imaginary spatial zones, as depicted by dotted lines. The first zone of the orifice (48) is centered lengthwise and stretches from the margin of the secondary end wall (22) through the strike member gap (32) to the strike member base (35). The second zone of the orifice (50) is contiguous and lateral to the first zone, and extends from the margin of the secondary end wall (22) to the tip of the first strike member prong (31). The third zone (52) is also contiguous and lateral to the first zone (48), and is opposite the second zone (50). The third zone (52) extends from the margin of the secondary end wall (22) to the tip of the second strike member prong (33).

Figure 2:
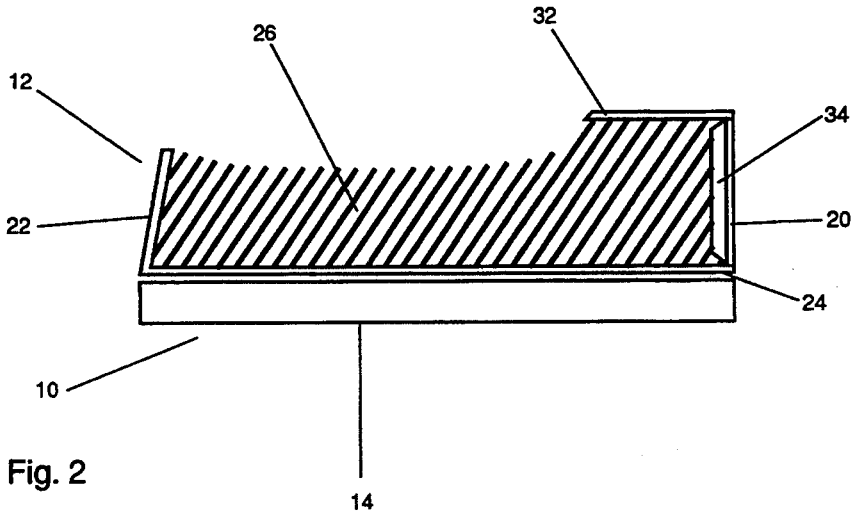
FIG. 2 is a cut-away side view of the preferred embodiment.

Referring to FIG. 2, which is a cut-away side view of Applicant's preferred embodiment, the secondary end wall (22) has an inner surface that is slightly angled, to retain the hinged end of the knife handle, when the knife is in position. The primary end wall (20) has an inner surface (34) that is coated with a compressible material such as compressible rubber to allow the butt end of the knife handle to remain firmly abutted against the primary end surface, when the knife is positioned in the housing member (12).

Figure 3:
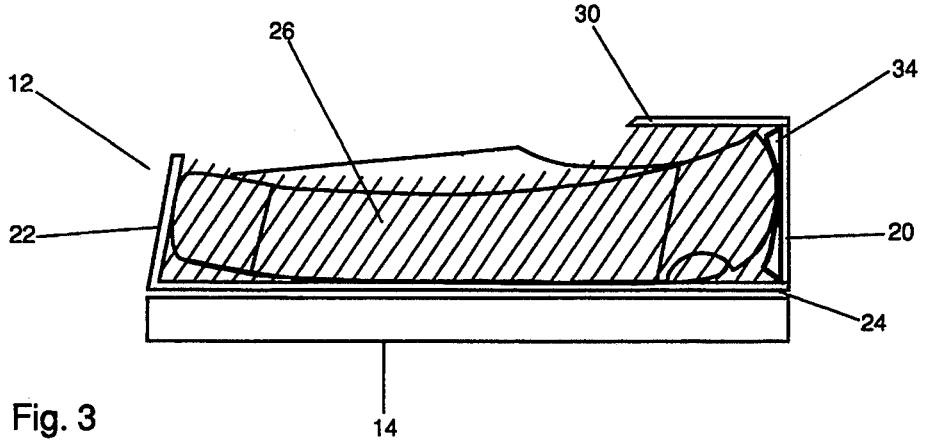
FIG. 3 is a cut-away side view of the preferred embodiment, showing the folding knife oriented in the knife holder.

Referring to FIG. 3, which is a cut-away side view of the preferred embodiment of Applicant's invention when the folding knife is in position, the folding knife is inserted, spine-first, through the orifice into the housing member recess (26), with the back side of the knife blade facing the orifice. The slightly angled secondary end inner surface (22) abuts the hinged end of the knife handle, while the compressible primary end inner surface (34) biases against the butt of the knife handle. The strike member (30) overlies the butt of the knife handle, thereby holding the knife in position.

Figure 4:
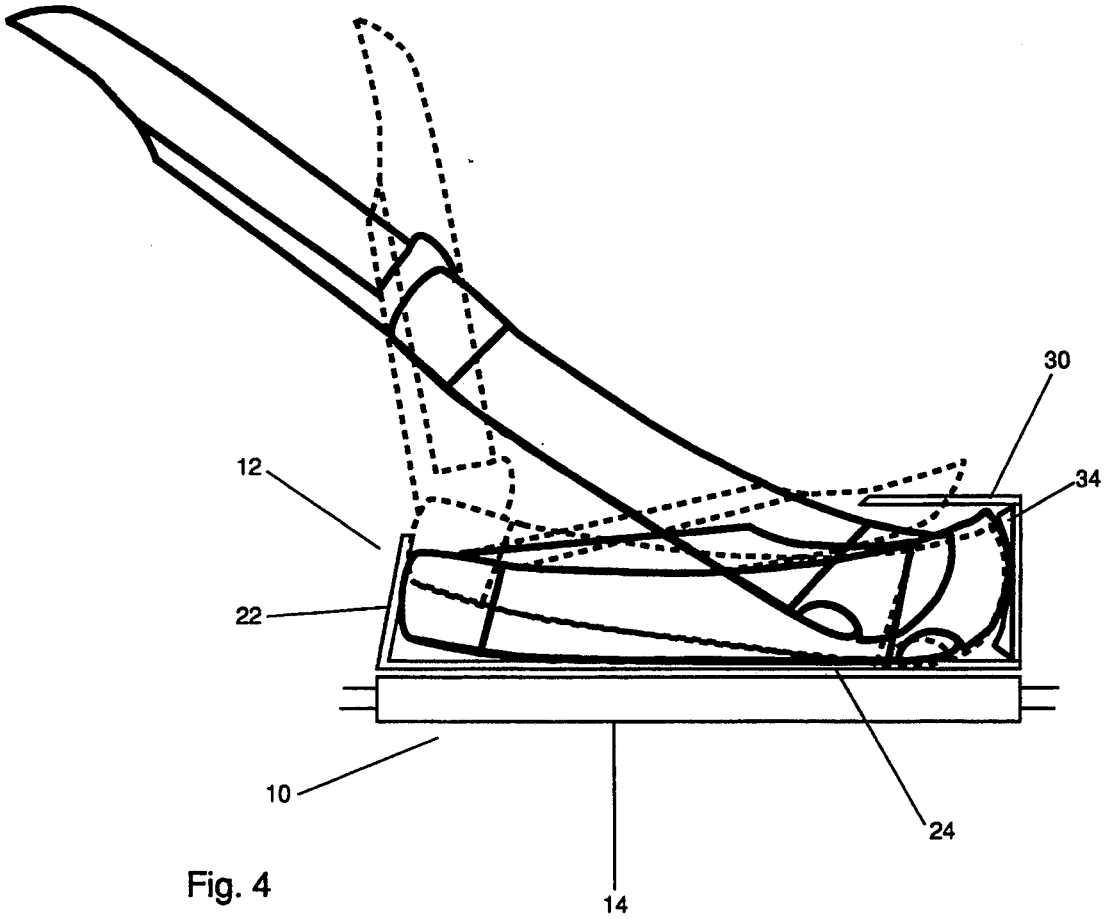
FIG. 4 is a cut-away side view of the preferred embodiment showing the removal of the folding knife from the housing member.

As illustrated by FIG. 4, as the back side of the knife blade is grasped and pulled in an outward direction, the strike member (30) blockingly engages the butt of the knife handle. As the pulling force on the knife blade is continued, the knife blade will pivot from the knife body and pass through the strike member gap (not shown), as the hinged end of the knife body disengages from its contact with the secondary end wall inner surface (22) and is freed from the housing member (12).

Figure 5:
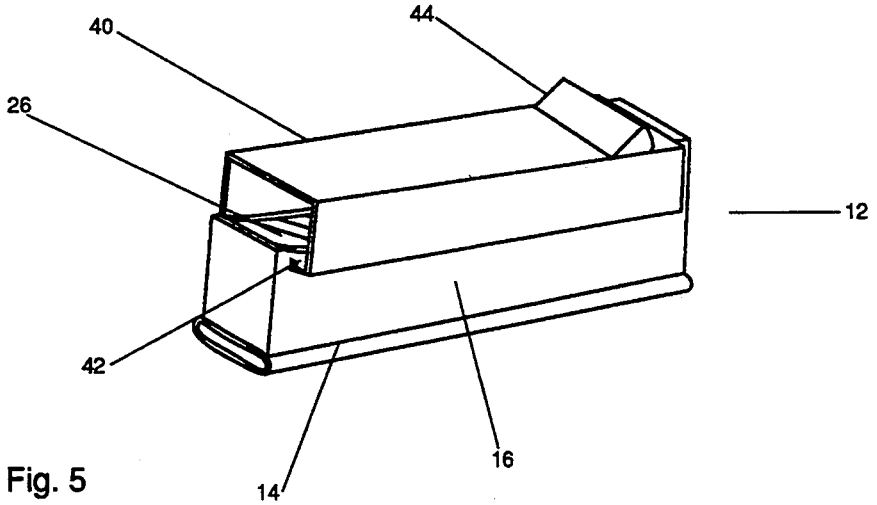
FIG. 5 depicts a perspective view of an optional embodiment, in which the knife holder has a cover, slidably engaged to the housing member

FIG. 5 represents an optional embodiment that contains an elongate cover (40), which substantially covers the orifice (28), and hides the knife from view. The cover has an elevated portion (44) to cover the strike member (not shown). The cover not only can serve ornamental purposes, but also will protect the knife from damage. The cover (40) is slidably attached to the housing member (12), by nesting the angled lower side margins (42) of the cover (40) into shallow grooves (not shown) located on the side walls of the housing member (12). Alternatively, the cover can be hingedly attached to the housing member, or be attached in other ways.

Figure 5A:
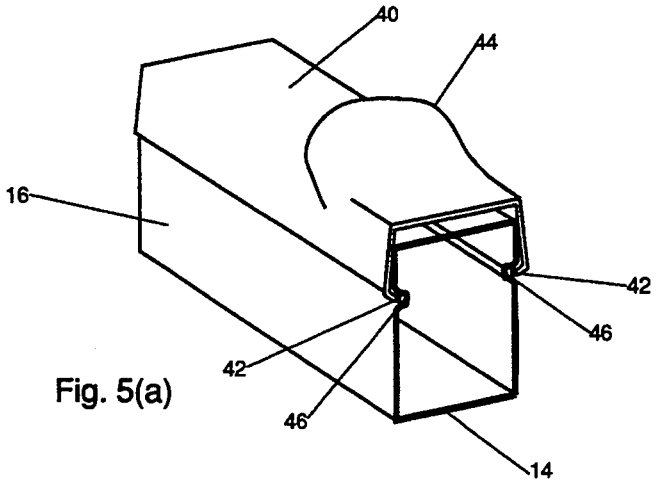
FIG. 5*a* depicts a different perspective view of the optional embodiment in which the knife holder has a cover, slidably engaged to the housing member.

Referring to FIG. 5*a*, the angled lower side margins (42) of the cover (40) nest within shallow grooves (46) on the housing member, and allow the cover to slide along the housing member.

Figure 6:
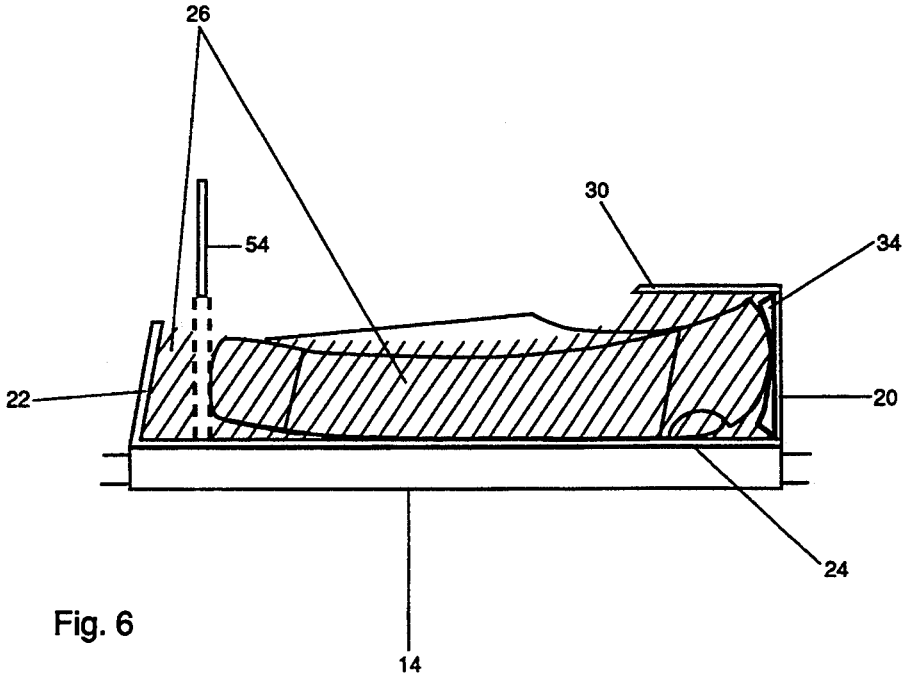
FIG. 6 depicts an exploded cut-away side view of an optional embodiment when the folding knife is in position and in which a spacer is inserted into the housing member recess to customize the knife holder to receive the folding knife.

Referring to FIG. 6, an additional optional embodiment of Applicant's invention, the housing member is equipped with a removable spacer (54) that is positioned in the housing member recess (26) to size the housing member recess for a specific knife, which may otherwise be too small to be retained in the housing member recess (26) by the end walls and the strike member (30). The removable spacer (54) can be affixed in the housing member recess in many ways, preferably by using glue or by having the spacer engage pegs on the inner base surface of the housing member. The spacer (54) is positioned in the housing member recess to abut the hinged end of the knife body and properly orient the knife in relation to the strike member (30). To further customize the holder, additional spacers can be positioned to abut the sides of the knife.

Although the invention has been described with reference to specific embodiments, this description is not meant to be construed in a limited sense. Various modifications of the disclosed embodiments, as well as alternative embodiments of the inventions, will become apparent to persons skilled in the art upon reference to the description of the invention. It is, therefore, contemplated that the appended claims will cover such modifications that fall within the scope of the invention.

I claim:

1. A folding knife holder for use with a folding knife, which knife comprises an elongate knife body, and a knife blade of a first knife blade length and a first knife blade thickness, which knife blade is pivotally attached to said knife body for moving between first and second blade positions relative to said knife body; said knife body having a first knife body end of a first knife body end width that is greater than said first knife blade thickness; a second knife body end; and first and second knife body sides positioned on either side of a knife body recess in which a portion of said knife blade resides when said knife blade is in said first blade position; said folding knife holder comprising:

a housing member having an elongate interior housing member recess, which housing member recess is defined by an elongate base surface substantially lying in and defining a first plane, a first side surface having a first side surface margin, a second side surface having a second side surface margin, a primary end surface having a primary end surface margin and a secondary end surface having a secondary end surface margin, said housing member recess being sized and shaped for substantially receiving therein said knife body, when said knife body is oriented in a first knife body orientation in said housing member recess, with the long axis of said knife body being substantially parallel to said first plane and said knife blade being in said first blade position; said first side surface margin, said second side surface margin, said primary end surface margin, and said secondary end surface margin defining an elongate orifice, opening into said housing member recess; said elongate orifice being sized and shaped to allow said knife body to pass through said elongate orifice, and be received in said housing member recess in said first orientation, and being further sized and shaped to allow said knife blade to be pivotably rotated from said knife body, from said first blade position to said second blade position, when said knife body is received in said housing member recess in said first orientation;

a strike member attached to said housing member, which strike member is positioned to occlude a portion of said elongate orifice and is sized and shaped to blockingly engage said first knife body end when said knife body is received in said housing member recess in said first orientation, and said knife blade is pulled in an outward first direction, away from said housing member; said strike member having a strike member gap of a first strike member gap width that is an intermediate width between said first knife body end width and said first knife blade thickness, which strike member gap is spatially positioned in said strike member to allow said knife blade to pass through said strike member gap when said elongate knife body is received in said housing member recess in said first orientation, and said knife blade is pivotably rotated from said first blade position to said second blade position.

2. The invention of claim 1, wherein said housing member recess is further sized and shaped for allowing said primary end surface of said housing member recess to abut said first knife body end, simultaneously with said secondary end surface abutting said second knife body end, when said knife body is received in said housing member recess in said first orientation.

3. The invention of claim 2, wherein said primary end surface of said housing member recess comprises a compressible pad, and wherein said secondary end surface of said housing member recess defines and lies substantially within a second plane; said second plane being oriented at an oblique angle relative to said first plane of said base surface.

4. The invention of claim 3, further comprising securing means attached to said housing member for removably securing said knife holder to a user of said knife holder.

5. The invention of claim 4 further comprising a cover member attached to said housing member, which cover member is removably positioned to substantially cover said elongate orifice.

6. The invention of claim 5 wherein said cover member is slidably attached to said housing member.

7. The invention of claim 1, further comprising first spacing means positioned in said housing member recess, and oriented in said housing member recess to abut against said second knife body end simultaneously with said primary end surface of said housing member recess abutting said first knife body end, when said knife body is received in said housing member recess in said first orientation.

8. The invention of claim 7, wherein said primary end surface of said housing member recess comprises a compressible pad.

9. The invention of claim 8, further comprising securing means attached to said housing member for removably securing said knife holder to a user of said knife holder.

10. The invention of claim 9, further comprising a cover member attached to said housing member, which cover member is removably positioned to substantially cover said elongate orifice.

11. The invention of claim 10 wherein said cover member is slidably attached to said housing member.

12. The invention of claim 10, further comprising second spacing means, positioned in said housing member recess, and oriented in said housing member recess to abut said first knife body side when said knife body is nested in said housing member recess in said first orientation.

13. A folding knife holder, comprising:

a base wall, first and second side walls, first and second end walls respectively at first and second body ends, and a strike member adjacent to said first end wall and opposite said base wall, which strike member has first and second strike member prongs, and a strike member gap between said first and second strike member prongs; said side walls, said base wall, said end walls and said strike member defining an elongate interior folding knife recess and an elongate recess opening, said recess being of a recess length, a recess width and a recess depth, said recess opening being substantially symmetrical relative to a longitudinal bisecting line;

said recess opening having an elongate opening center portion, centered lengthwise on said longitudinal bisecting line, said opening center portion being of a first opening length, and delineated at said second body end by a second end wall margin of said second end wall, with a blade tip subset of said opening center portion extending between said first and second strike member prongs and through said strike member gap;

said recess opening further having an elongate opening first side portion, contiguous and lateral to said opening center portion, which opening first side portion is of a second opening length, said second opening length being less than said recess length when measured substantially parallel with said bisecting line and delineated near said second body end by said second end wall margin and near said first body end by said first strike member prong;

said recess opening further having an elongate opening second side portion, contiguous and lateral to said opening center portion and opposite said opening first side portion, which opening second side portion is of a third opening length, said third opening length being less than said recess length when measured substantially parallel with said bisecting line and delineated near said second body end by said second end wall margin and near said first body end by said second strike member prong.

14. A method for safely carrying and opening with one hand a folding knife, comprising the steps of:

selecting a folding knife, comprising an elongate knife body, and a knife blade of a first knife blade length and a first knife blade width, which knife blade is pivotally attached to said knife body for moving between first and second blade positions relative to said knife body; said knife body having a first knife body end of a first knife body end width that is greater than said first knife blade width; a second knife body end; and first and second knife body sides positioned on either side of a knife body recess in which a portion of said knife blade resides when said knife blade is in said first blade position;

selecting a knife holder for said knife, said knife holder comprising:

a housing member having an elongate interior housing member recess, which housing member recess is defined by an elongate base surface substantially lying in and defining a first plane, a first side surface having a first side surface margin, a second side surface having a second side surface margin, a primary end surface having a primary end surface margin and a secondary end surface having a secondary end surface margin, said housing member recess being sized and shaped for substantially receiving therein said knife body, when said knife body is oriented in a first knife body orientation in said housing member recess, with the long axis of said knife body being substantially parallel to said first plane and said knife blade being in said first blade position; said first side surface margin, said second side surface margin, said primary end surface margin, and said secondary end surface margin defining an elongate orifice, opening into said housing member recess; said elongate orifice being sized and shaped to allow said knife body to pass through said elongate orifice, and be received in said housing member recess in said first orientation, and being further sized and shaped to allow said knife blade to be pivotably rotated from said knife body from said first blade position to said second blade position, when said knife body is received in said housing member recess in said first orientation;

a strike member attached to said housing member, which strike member is positioned to occlude a portion of said elongate orifice and is sized and shaped to blockingly engage said first knife body end when said knife body is received in said housing member recess in said first orientation, and said knife blade is pulled in an outward first direction, away from said housing member; said strike member having a strike member gap of a first strike member gap width that is an intermediate width between said first knife body end width and said first knife blade width, which strike member gap is spatially positioned in said strike member to allow said knife blade to pass through said strike member gap when said knife body is received in said housing member recess in said first orientation, and said knife blade is pivotably rotated from said first blade position to said second blade position;

inserting said knife with said blade in said first knife blade position, through said elongate orifice into said housing member recess;

positioning said knife in said housing member recess in said first orientation;

grasping said knife blade with the fingers of one hand;

pivotably rotating said knife blade from said knife body recess from said first knife blade position to said second knife blade position, by pulling said knife blade in an outward direction with the fingers of said one hand, away from said knife holder; and releasing said grasp on said knife blade and sliding the hand to said knife body as said knife blade is pivotably rotated to a third, fully open position.

15. The method of claim 14, wherein said housing member recess is further sized and shaped for allowing said primary end surface of said housing member recess to abut said first knife body end, simultaneously with said secondary end surface abutting said second knife body end, when said knife body is received in said housing member recess in said first orientation; wherein said primary end surface of said housing member recess comprises a compressible pad; wherein said secondary end surface of said housing member recess defines and lies substantially within a second plane, which second plane is oriented at an oblique angle relative to said first plane of said base surface; and wherein said knife holder further comprises securing means attached to said housing member for removably securing said knife holder to a user of said knife holder.

16. The method of claim 14, wherein said holder further comprises first spacing means, positioned in said housing member recess, and oriented in said housing member recess to abut against said second knife body end when said knife body is received in said housing member recess in said first orientation; wherein said primary end surface of said housing member recess comprises a compressible pad; and wherein said knife holder further comprises securing means attached to said housing member for removably securing said knife holder to a user of said knife holder.

17. The method of claim 15 wherein said knife holder further comprises a cover member attached to said housing member, which cover member is removably positioned to substantially cover said elongate orifice.

18. The method of claim 16, wherein said knife holder further comprises a cover member attached to said housing member, which cover member is removably positioned to substantially cover said elongate orifice.

* * * * *